United States Patent [19]

Bassi

[11] 4,176,627

[45] Dec. 4, 1979

[54] FUEL-INTERMITTENT-INJECTION INSTALLATION FOR INTERNAL-COMBUSTION ENGINES

[75] Inventor: Aldo Bassi, Milan, Italy

[73] Assignee: Alfa Romeo S.p.A., Milan, Italy

[21] Appl. No.: 827,685

[22] Filed: Aug. 25, 1977

[30] Foreign Application Priority Data

Sep. 6, 1976 [IT] Italy ..... 26911 A/76

[51] Int. Cl.[2] ..... F02B 3/00

[52] U.S. Cl. ..... 123/32 EB

[58] Field of Search ..... 123/32 EA, 32 EB, 32 G, 123/32 AE, 32 EG, 32 EH, 140 MC

[56] References Cited

U.S. PATENT DOCUMENTS

| | | | |
|---|---|---|---|
| 3,906,207 | 9/1975 | Rivere et al. | 123/32 EB |
| 3,971,348 | 7/1976 | Scofield | 123/32 EA |
| 4,034,722 | 7/1977 | Miyakawa | 123/32 EB |
| 4,075,983 | 2/1978 | Robinson | 123/32 EA |
| 4,086,884 | 5/1978 | Moon et al. | 123/32 EB |

*Primary Examiner*—Gerald Brigance
*Attorney, Agent, or Firm*—Charles E. Brown

[57] ABSTRACT

An electronic control circuit for the fuel injectors of an internal combustion engine is disclosed, which comprises a circuitry for detecting certain indicative parameters of the engine working conditions and of the power requirements requested by the engine operator, electronic circuitry means being provided for generating pulse train signals to be compared with the signals corresponding to the detected parameters and circuitry means for effecting a comparison with one of a series of preselected patterns of injector feed (intermittency of feed and duration of each feeding burst) thus enabling a control circuit to enter action so as to adapt the operation of the injectors to the preselected pattern. The operator has thus a comparatively wide choice among a number of typical engine operative situations. Consistent fuel savings can thus be obtained along with a more regular engine run.

3 Claims, 2 Drawing Figures

FUEL-INTERMITTENT-INJECTION INSTALLATION FOR INTERNAL-COMBUSTION ENGINES

Figure 1:
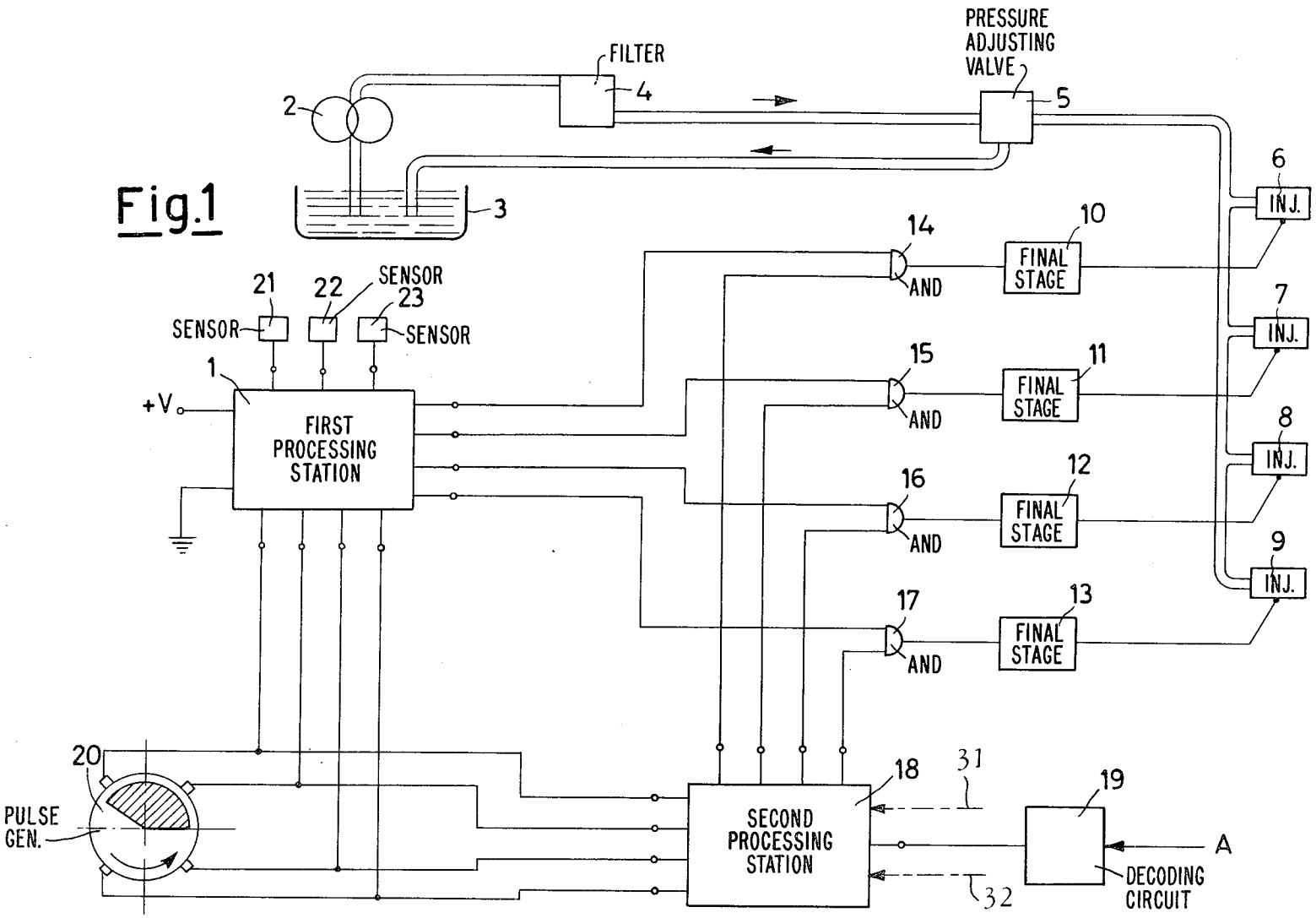

In all the internal combustion engines, the delivered power is adjusted, at present, by the driver himself who acts on the density of the charge of air and gasoline (engines fed by carburettors) or of air (engines fed by injection) drawn by the cylinders by the agency of a throttling valve which is connected to the accelerator pedal.

This invention relates to a novel system for adjusting the power delivered by an explosion engine, which is based on the control of the delivery of the fuel rather than on the adjustment of the density of the charge drawn by the engine. According to the invention, the fuel feed to the cylinders follows a particular low of variation which is composed by a model of intermittency in the delivery of the injectors of the several cylinders. The injection of the fuel into one or more cylinders of the engine is either permitted or stopped at every cycle of the engine and, for an appropriate number of cycles, according to a preselected scheme, correlated to the power requested for the engine since the power delivered by the engine is the algebraic sum of the contributions of the active cycles and of that of the nonactive or passive cycles.

Obviously, in order not to impair the periodical regularity of the engine, it is necessary that the intermittence pattern in the delivery of fuel is performed according to a well defined "intermittency plan" for all the cylinders which are present in the engine.

Stated another way, the law of the intermittency of the inflow of gasoline into a cylinder must be a function of the power demand, whereas the phase shift of the intermittency laws in the several cylinders must be studied in such a way as to be enabled to take into account the degree of periodical irregularlity of the angular speed of the engine.

This invention thus consists of a system, which is preferably embodied by an electronic circuitry, which is capable of detecting the working conditions of the engine and of giving (or not), consistently with the power demand of the driver, the consent to an injector for the delivery of fuel.

The principal advantages stemming from such a system of adjustment of the engine power are substantially the following:

(a) inasmuch as the density of the charge in the active cylinders is always the same and is equal to the maximum value which substantially corresponds to the atmospherical pressure, the inflammability of the charge and the propagation of the flame are brought to an optimum all the field of the operation of the engine throughout.

(b) on account of the fact that there is no throttle, the pressure drops along the intake ducts are reduced and thus the volumetric efficiency of the engine is improved. In addition, the power losses during the pumping stage are reduced since the minimum pressure in the cylinder during the intake phase is increased.

This situation is such as to improve the efficiency of the engine and the result is a reduced fuel usage.

The installation is characterized in that it comprises an injector for each cylinder of the engine, a circuit for feeding the fuel to the injector under a preselected pressure, a pulse generator which is rotated at a speed which is proportional to that of the engine and is capable of delivering as many trains of first pulse signals as there are injectors, a processing circuit which is operatively connected to the pulse generator and is capable of converting said trains of first pulse signals into as many trains of second pulse signals having a preselected intensity and duration, a control circuit also operatively connected to said pulse generator and further connected to drive means which can be actuated by the driver, in the control circuit there having been stored preselected different models of intermittency for the delivery of fuel by the injectors as a function of the conditions of operation of the engine, the control circuit carrying out the combination of said first pulse signals and of the drive signal to generate control signal sequences for each injector consistently with the stored models in the same control circuit, the installation further comprising logical circuits in a number equal to that of the injectors and operatively connected to injector-actuating means and also operatively connected to said processing circuit and to said control circuit, each logical circuit carrying out the comparison between the pulse signal associated to a cylinder coming from the processing circuit and the control signal coming from the control circuit associated to the same cylinder in order to generate a consent or an inhibition signal for the means of actuation of the injector which feed the same cylinder, the energization of the several logical circuits being commanded by the control circuit and by the processing circuit according to a sequence which has been preselected on the basis of the ignition sequence of the cylinders.

Figure 2:
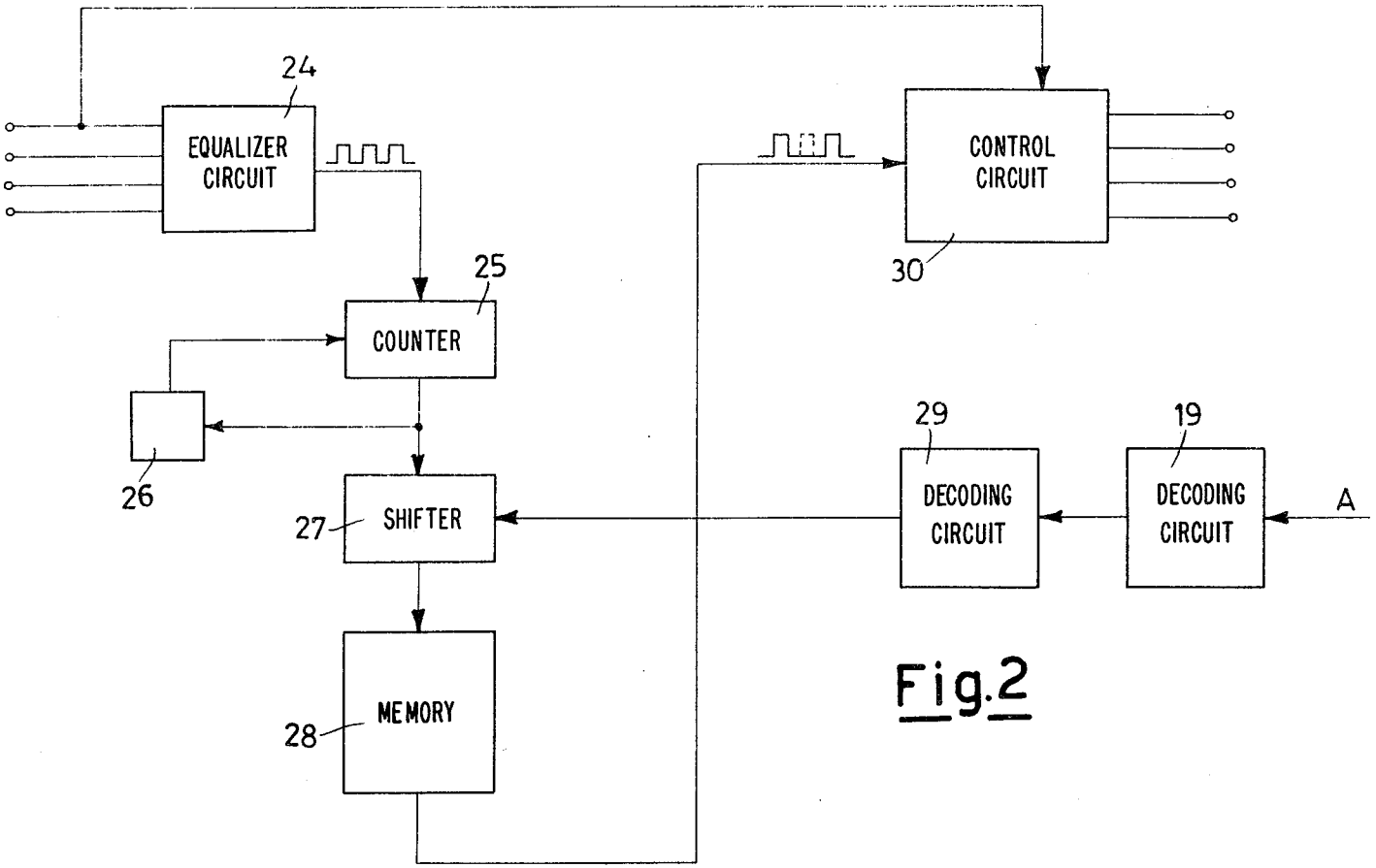

The properties of the invention can be better understood by examining FIGS. 1 and 2 in which a block diagram is shown of a preferred embodiment of the present invention.

FIG. 1 shows a diagram of the installation as embodied for an electronic injection system.

It comprises a hydraulic circuit which delivers the fuel to the injectors 6,7,8,9 under a predetermined constant pressure and comprises a tank 3, a pump 2, a filter 4 and a pressure-adjusting valve 5.

The injectors are electromagnetic valves which are energized by an electric signal as delivered via the final stages 10,11,12,13.

The rate of flow of fuel as delivered by the injectors is determined, since the feeding pressure is a constant, by the opening time of the electrically operated injectors. The signal for the driving of each electrically operated injector is a train of rectangular wave pulses the intensity and duration of which are preselected and is supplied by the processing circuit of the station 1, the task of which is to process the signals coming from the pulse generator 20 and which are composed by as many pulse trains as there are electrically actuated injectors (in the case in point, these are four since a 4-cylinder engine is shown). The station 1 also receives, through the sensors 21,22,23, signals of correction relative to particular working conditions of the engine, such as start, warmup, ambient air temperature, etc. These correction signals are such as to vary the duration of the pulses of the output signals of the station 1, so as correspondingly to modify the delivery of the injectors.

From the signals composed by pulse trains coming from the generator 20, the latter being mechanically connected to the engine crankshaft, there are also drawn phasing signals for determining the beginning of the delivery by the injectors in the intake stage of each cylinder.

The pulse trains delivered by the generator 20 are sent not only to the station 1, but also to a second station 18, which is fitted with a control circuit in which are stored several preselected intermittency models for the delivery of fuel by the injectors. The control circuit of station 20 delivers as outputs the signals which correspond to the intermittency model as indicated by the decoding device 19 on the basis of the drive signal A which represents the power demand coming from the vehicle driver.

The station 18 delivers control signals for the injectors in phase with those coming from the generator 20 and reach the AND circuits 14,15,16,17 together with the signals coming from the station 1, in such a way that to the same final stages 10 11 12 13 can arrive the complete information both as to the model of intermittency and the injection time. To each AND circuit, which is connected to the energization stage of an electrically actuated injector, come two signals, one supplied by the station 1 and the other supplied by the station 18, both associated to a cylinder. Consistently with the relative voltage levels of these two signals each AND circuit generates a signal which drives to conduction or to cutoff the energization stage of the corresponding electrically actuated injector.

The action of the different logical circuits is controlled by the station 18 according to a sequence which has been preselected consistently with the ingnition sequence of the cylinders.

The station 18 as shown in one possible configuration in the block diagram of FIG. 2, is essentially composed by a storage 28 which contains all the intermittency models for the delivery of the fuel by the injectors as forecast for covering all the field of operation of the engine, from maximum throttling to full power. The selection of one of these models or patterns is made by a decoding circuit 29,19 which converts a voltage signal A, which is proportional to the power requested by the driver to the engine, into a number which is the address of the storage compartment in which the relevant intermittency model is stored. The operation substantially consists of the following sequence of operations: the signals formed by the four pulse trains coming from the pulse generator 20 enter the circuit 24 which equalizes all of them and conveys them sequentially towards the single output of the same circuit.

These signals then enter a counter 25 which, through the counting of the incoming signals determines the number of cycles carried out by the engine by utilizing a certain intermittency model. Once the maximum of the number of the engine-cycles attributed to a certain intermittency model (for example 30 engine cycles), the intermittency model can be repeated or it can be changed consistently with the magnitude of the drive signal A.

To reset the counter after that the maximum number has been attained, the resetting circuit 26 is energized. The output signal emerging from the counter 25 each time a predetermined number of cycles has been carried out by the engine is shifted by the automatic shifter to the compartment of the memory 28 which is identified by the address signal at the output of the decoding circuit 19, 29.

In that memory compartment there is stored a predetermined model of intermittency which corresponds to the present signal A, i.e. to the power presently requested by the driver. Said model of intermittency is thus selected and, as a result, the memory 28 delivers a corresponding sequence of pulses which have a valve of 1 or 0 to indicate whether they are intended to cause actuation of corresponding fuel injectors or not.

The pulse sequence emerging from the memory 28 is then delivered to a circuit 30 which is in a position to send to each electrically operated injector the appropriate signal on the basis of the sequence of action of the four electrically actuated injectors as determined (consistently with the ignition sequence of the cylinders) by the signals at the input to the station 18. At every engine cycle, an electrically actuated injector may receive a consent or cutoff signal according to what has been provided for by the intermittency model used under the particular working condition.

More particularly, in the station 18 there can be stored an appropriate intermittency model which enables the engine to run with very reduced fuel consumption under working conditions such as a motorway run of a motor car fitted with that engine. This mode of use can be assimilated to that of a conventional engine in the case of a motor car having an overdrive speed change gear.

In this case, the station 18 receives the signals (shown in FIG. 1 by the two dash-and-dot arrows 31 and 32) which are delivered by appropriate sensors which are capable of detecting the preselected engine working conditions and the preselected conditions of use of the car in which it is provided for using the optimized intermittency model so as to achieve a minimum fuel consumption.

I claim:

1. An intermittent fuel injection installation for an internal combustion engine having a plurality of cylinders, said installation being characterized in that it comprises an injector for each cylinder of the engine, a fuel-feeding circuit for supplying fuel for said injectors under a preselected pressure, a pulse generator rotatable at a speed proportional to that of the engine and being capable of emitting as many trains of first pulse signals as there are injectors, a processing circuit operatively connected to the pulse generator and being capable of converting said trains of first pulse signals into as many trains of second pulse signals of a preselected magnitude and duration, a control circuit also operatively connected to said pulse generator and further connected to drive means actuable by an operator of the engine and operable to produce drive signals, there being stored in said control circuit preselected and pre-established models of intermittency for the delivery of the fuel by the injectors as a function of the conditions of use of the engine, the control circuit being operable to combine said first pulse signals with said drive signal for generating sequences of control signals for each injector consistent with said models of intermittency stored in said control circuit, the installation further comprising logic circuits in a number equal to the number of the injector and operatively connected to actuation means for the same injectors and also to said processing circuit and said control circuit, each logic circuit effecting a comparison between the pulse signal associated with the injector of a cylinder coming from the processing circuit and the control signal coming from the control circuit associated with the injector of the same cylinder for selectively generating a consent or inhibition signal for the means of actuation of the injector which feeds the same cylinder, the action of the several logic circuits being commanded by the control circuit and the processing circuit according to a sequence which has been previously established on the basis of the ignition sequence of the cylinders.

2. An injection installation according to claim 1, characterized in that the processing circuit is operatively connected to sensors which are capable of detecting parameters indicative of particular working conditions of the engine such as start, warmup, temperature and pressure of the ambient air.

3. An injection installation according to claim 1, characterized in that the control circuit contains stored therein a particular intermittency pattern which is an optimum for the operation of the engine with a minimum fuel consumption under preselected working condition of the engine and under preselected conditions of use of the car which has been fitted with said engine, the control circuit being operatively connected to means capable of detecting said preselected working conditions of the engine and said preselected conditions of use of a vehicle of which the engine is a part in order to generate under such same conditions control signals for the injectors of the several cylinders consistently with said particular intermittency pattern.

* * * * *